US006631725B2

(12) United States Patent
Gray

(10) Patent No.: US 6,631,725 B2
(45) Date of Patent: Oct. 14, 2003

(54) MOISTURE-CONTROLLED FLEXIBLE HAIR CURLER

(76) Inventor: Diane L. Gray, 227 Ridgely Rd., Verona, PA (US) 15147

( * ) Notice: Subject to any disclaimer, the term of this patent is extended or adjusted under 35 U.S.C. 154(b) by 45 days.

(21) Appl. No.: 09/881,306

(22) Filed: Jun. 13, 2001

(65) Prior Publication Data

US 2002/0189630 A1 Dec. 19, 2002

(51) Int. Cl.[7] ..... A45D 2/36
(52) U.S. Cl. ..... 132/233; 132/243; 132/251
(58) Field of Search ..... 132/210, 211, 132/220, 233, 222, 223, 226, 227, 234, 251, 254, 277; 219/222

(56) References Cited

U.S. PATENT DOCUMENTS

| | | | | | |
|---|---|---|---|---|---|
| 4,041,961 | A | | 8/1977 | Shaler et al. | |
| 4,164,951 | A | | 8/1979 | Shaler et al. | |
| 5,025,816 | A | * | 6/1991 | Jones | 132/247 |
| 5,030,820 | A | | 7/1991 | Gibbon | |
| 5,456,701 | A | | 10/1995 | Stout | |
| 5,819,763 | A | * | 10/1998 | Hallowell, II | 132/247 |
| 6,064,051 | A | * | 5/2000 | Gray | 219/759 |
| 6,079,422 | A | * | 6/2000 | Drago et al. | 132/247 |

* cited by examiner

*Primary Examiner*—Eduardo C. Robert
*Assistant Examiner*—David Comstock
(74) *Attorney, Agent, or Firm*—William L. Krayer

(57) ABSTRACT

A flexible hair curler formed from a gel of crosslinked polyacrylamide including a humectant, and encased in a moisture-permeable flexible sheath, preferably of fabric.

20 Claims, 5 Drawing Sheets

MOISTURE-CONTROLLED FLEXIBLE HAIR CURLER

TECHNICAL FIELD

This invention relates to hair curlers for professional and non-professional use. The hair curlers can be heated in a home microwave, and will emit moisture which is replenished during storage between uses.

BACKGROUND OF THE INVENTION

As related in my earlier U.S. Pat. No. 6,064,051, there is a need for a convenient hair curler which will retain heat, particularly heat from a domestic microwave, and emit moisture during use. In the '051 patent, I disclosed the concept of employing a gel comprising a crosslinked water soluble polymer, a humectant, and water as a heat-retaining composition capable of emitting moisture during use in a heated condition. In FIG. 2, the gel is illustrated in a layer contained in a fabric sheath, forming a tube-like construction. The tube-like device is retained by a rigid plastic support, preferably in the shape of a hollow cylinder. The present invention is an improvement on the basic concept of the invention of U.S. Pat. No. 6,064,051, which is incorporated entirely herein by reference.

SUMMARY OF THE INVENTION

The present invention employs a gel of a composition similar to that described in my U.S. Pat. No. 6,064,051, but uses it in a different physical form and utilizes a moisture-permeable support which does not require a supplemental rigid support. The gel is in a substantially cylindrical form and, in spite of its high water content, is firm but resilient and flexible. It is encased preferably in two layers of moisture-permeable fabric or flexible film, which assures that its physical shape will be retained while it may be bent or even curved back upon itself and yet retain its original cylindrical form when released. The two (preferably) layers of moisture-permeable material assure that the gel is retained in place, but also are excellent for ease of manufacture.

The curler comprises a rod-shaped body of gel surrounded by a tube-like moisture-permeable sheath, further encased in a second moisture-permeable sleeve which may be enclosed at the ends. This means that the gel can be extruded or otherwise more or less continuously placed inside the inner sheath, and the composite article can be made in long lengths which are then cut for making individual curlers. The curler-length pieces are then inserted into somewhat longer moisture-permeable sleeves of fabric having a slightly larger internal diameter. The longer sleeves preferably extend on both ends beyond the ends of the sheath/gel segments inside them, so the ends can be stitched or otherwise closed, optionally leaving a loose extension for tying or attachment of a cord, strap or length of fabric for fastening to the other end to form a circle if desired.

DETAILED DESCRIPTION OF THE INVENTION

Figure 1:
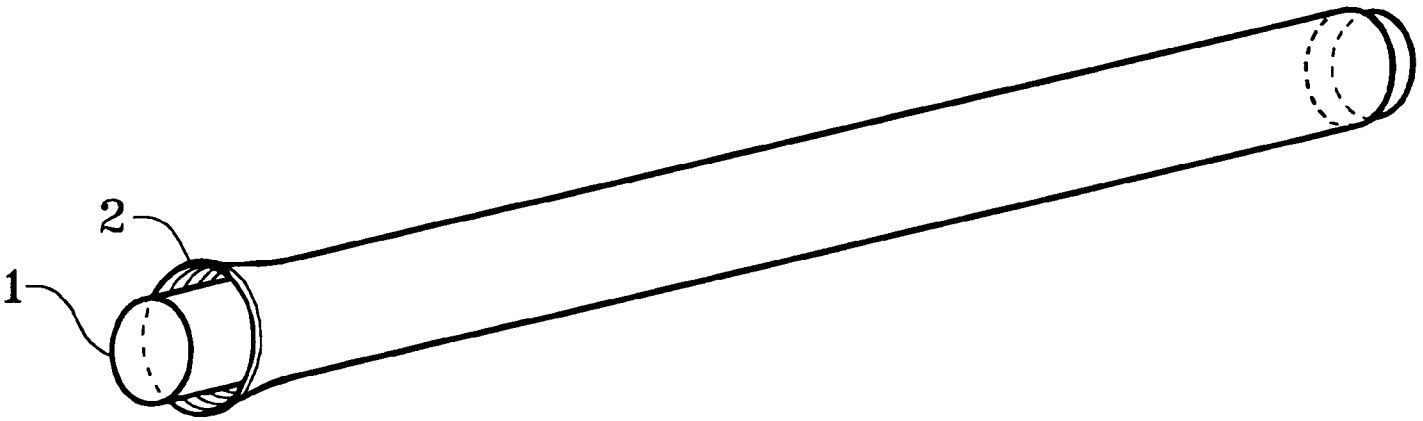
FIG. 1 is a perspective view of a preferred form of my curler.

Referring now to FIG. 1, gel 1 is in a cylindrical form and is of a rubbery consistency that will not visibly leak moisture. The tubular fabric sheath 2 fits firmly around the cylindrical gel 1, to form my curler core. The fabric is permeable to moisture. The fabric should also be flexible and expansible, and sheath 2 is shown in a slightly expanded portion at one end to illustrate its stretching capabilities.

The gel comprises water, a humectant, and a crosslinked water-soluble polymer. The amount of crosslinking should be such that the gel is firm and stable but still pliable. Compositions such as are disclosed and described by Stout in U.S. Pat. No. 5,456,701 are preferred. The preferred crosslinked water soluble polymer is a polyacrylamide preferably crosslinked with methylene bisacrylamide. The preferred composition contains a significant amount of a humectant. Glycerin is very effective as the humectant. Inorganic desiccant solutions may also be used, such as the combinations of lithium and calcium bromides and chlorides disclosed by Heath and Minger in U.S. Pat. No. 2,143,008. Both the Stout U.S. Pat. No. 5,456,701 and the Heath et al U.S. Pat. No. 2,143,008 are incorporated herein by reference. Also included in the gel composition is sufficient water for the crosslinked water soluble polymer to provide a gel consistency for the composition and, where inorganic humectants or desiccants are used, to dissolve them. Generally about 10% to 80% water is used.

The basic ingredients of a preferred gel therefore are (a) 10–30% by weight acrylamide crosslinked by 0.04–0.2% crosslinker such as methylene bisacrylamide, 20–85% humectant, and 10–80% water. Crosslinking should be performed in the presence of the humectant to be sure the humectant is evenly dispersed in the gel. These ingredients will make a gel having the rubbery and flexible character I require. Other gel compositions may be used—generally any gel which may be heated in a microwave oven and/or which contains a humectant; compositions described in U.S. Pat. No. 4,671,267, hereby incorporated by reference, can be used. However, the gel forming components—the crosslinking polymer—must not be destroyed or dissociated by repetitive heating and cooling, and repetitive adsorption and desorption of moisture. The components recited above are able to perform well after many repetitions of use.

Figure 2:
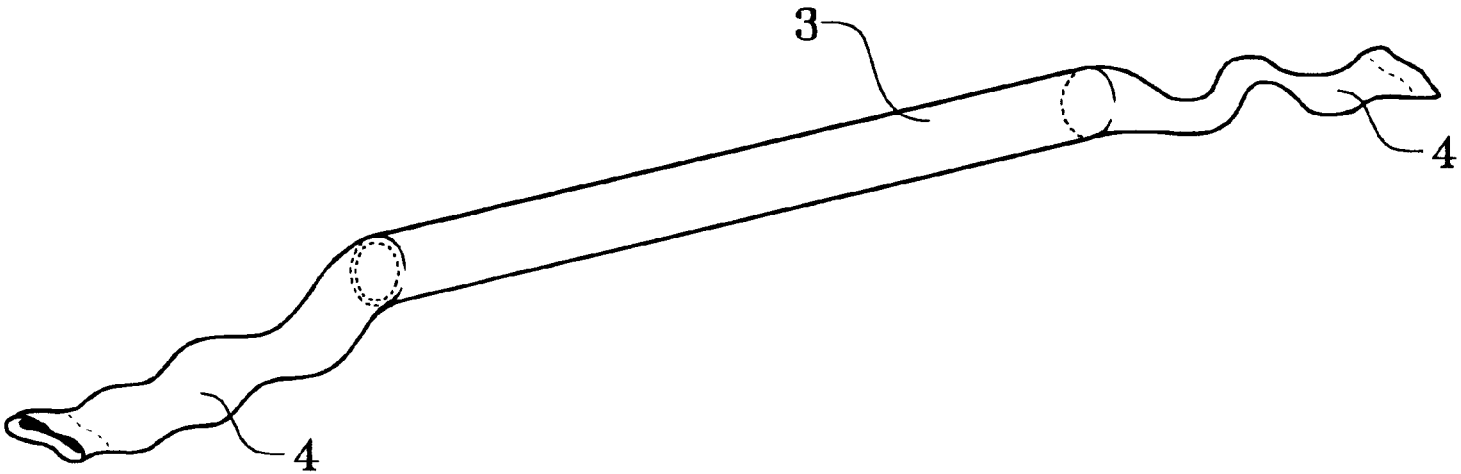
FIG. 2 shows another preferred form of the curler, having extensions for tying or fastening.

In FIG. 2, a preferred form of my invention is shown, in which the core shown in FIG. 1 including sheath 2 is further encased in a sleeve 3 having extensions 4. Sleeve 3 is preferably made of the same fabric as sheath 2. Sleeve 3 reinforces sheath 2 and, having optional extensions 4, provides a convenient device for handling or tying.

Figure 3:
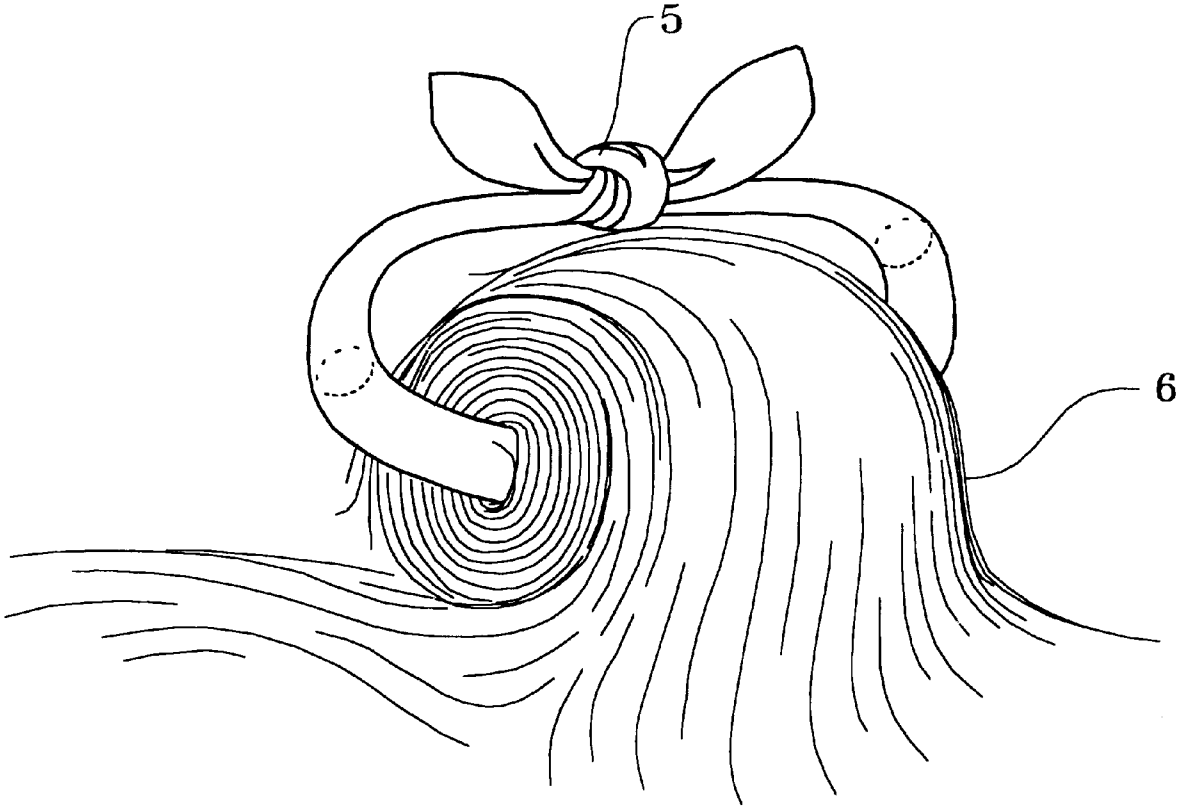
FIG. 3 shows the curler in one form of use with the ends tied.

FIG. 3 shows the curler 3 in place in hair 6, the extensions 4 having been formed into a knot 5. This is an optional manner of use.

Figure 4:
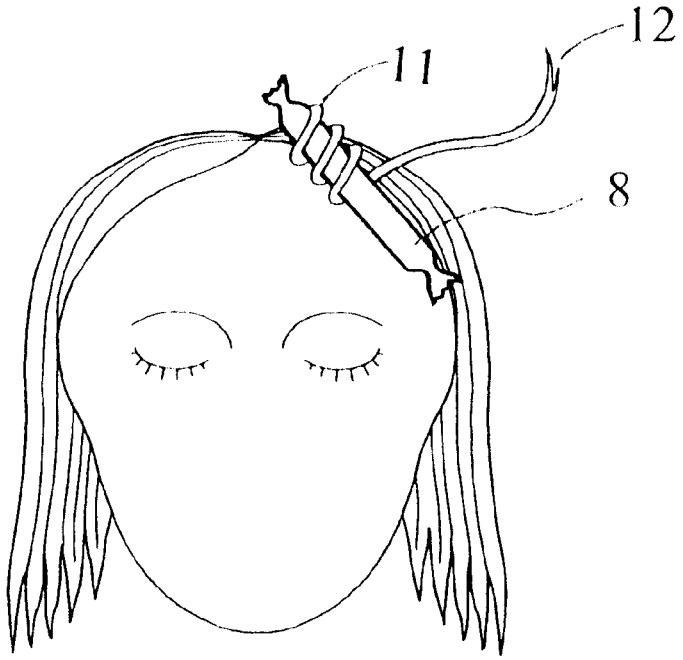
FIG. 4 illustrates a preferred method of curling the hair.

In FIG. 4, the hair strands 11 are shown partly curled around heated curler 8. Note that the user has started the curling from the root ends and that end 12 of hair strands 11 is still loose.

Figure 5:
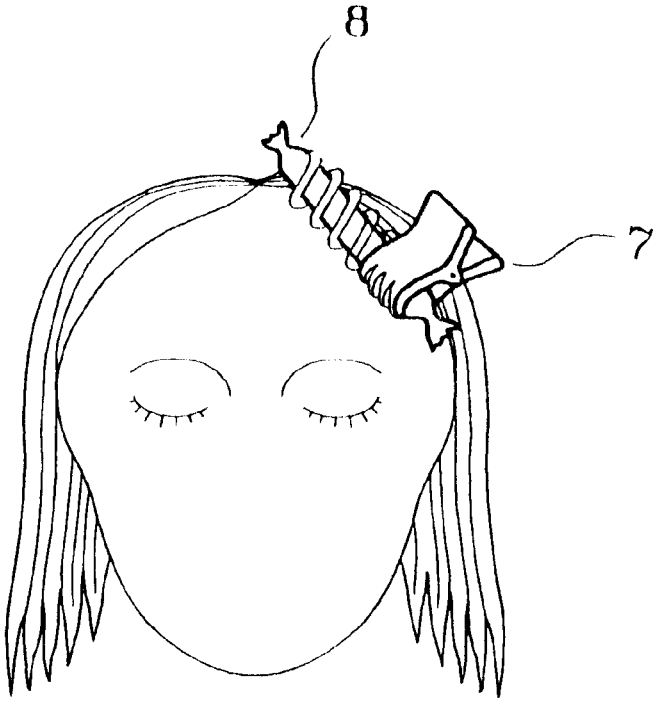
In FIG. 5, a curler is in use, held in place by a clasp.

When the hair strands 11 are entirely in place on curler 8 as shown in FIG. 5, a clasp 7 can be used to hold them in place on curler 8.

Figure 6:
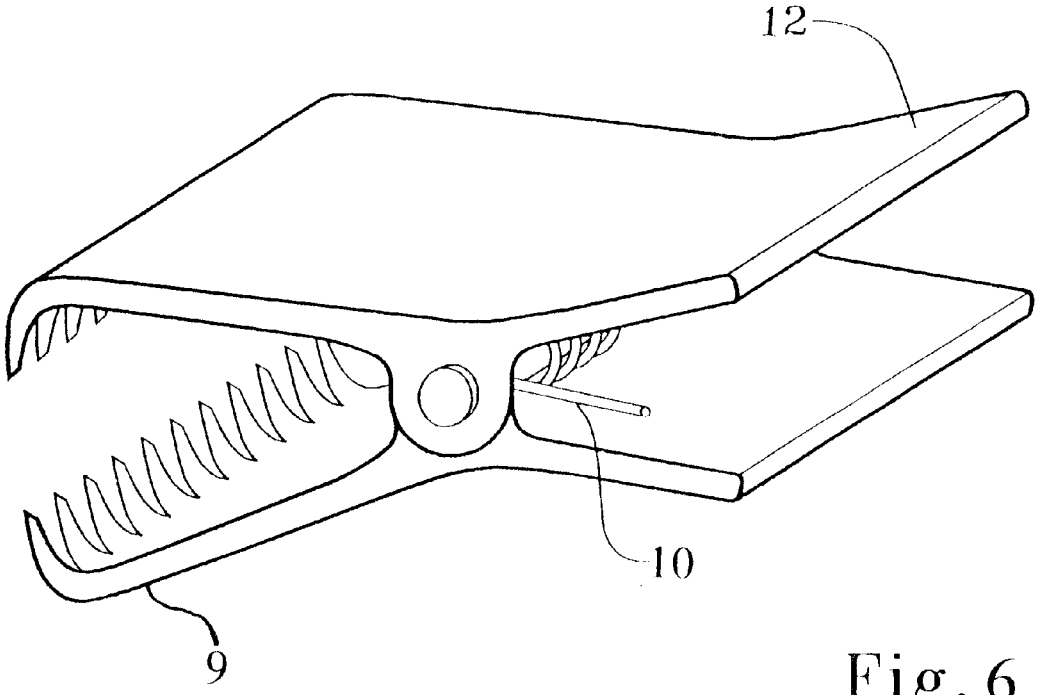
FIG. 6 illustrates a clasp of the type used in FIG. 5.

Any suitable clasp can be used but I prefer one such as is shown in FIG. 6, having two arms 9 actuated by spring 10 by squeezing handles 12.

Thus it is seen that my invention includes a flexible, substantially cylindrical hair curler comprising (a) a substantially cylindrical core comprising a gel in the shape of a cylinder and having a rubbery and flexible consistency, comprising about 10–30% acrylamide, about 10–80% water, about 20–85% humectant, and 0.04–0.2% crosslinker, and (b) a flexible, moisture-permeable sheath encasing the gel.

My invention further includes a hair curler comprising (a) a flexible tubular moisture-permeable (preferably expansible fabric) sheath filled with a rubbery, flexible gel comprising a crosslinked water soluble polymer, a humectant, and water, and (b) a flexible, moisture-permeable (preferably expansible fabric) sleeve retaining the sheath, the sleeve having end portions extending beyond the ends of the fabric sheath. Additionally, it should be understood that a similar sheath and gel not including a humectant may be used as a disposable curler. That is, my invention includes a curler such as that just recited, without the humectant. Additionally, the gel need not be of the crosslinked polyacrylamide type, but any gel capable of absorbing heat and imparting it to the hair, and desorbing moisture at least once.

What is claimed is:

1. A flexible hair curler comprising a flexible tubular moisture-permeable sheath filled with a rubbery, flexible gel capable of absorbing and desorbing heat and desorbing moisture at least once.

2. A hair curler of claim 1 wherein said gel comprises crosslinked polyacrylamide and includes water and a humectant.

3. A hair curler of claim 2 including a flexible moisture-permeable sleeve retaining said sheath, said curler having end portions extending beyond the ends of said sheath, wherein said end portions comprise fabric extensions of said moisture-permeable sleeve.

4. A hair curler of claim 2 wherein said gel is capable of retaining heat when heated in a microwave.

5. A hair curler of claim 2 wherein said gel is capable of retaining heat when heated in a microwave.

6. A hair curler of claim 2 wherein said gel is capable of releasing moisture when heated.

7. A hair curler of claim 2 wherein said humectant comprises glycerine.

8. A hair curler of claim 2 wherein said sheath is fabric.

9. A flexible, substantially cylindrical hair curler comprising (a) a substantially cylindrical core comprising a gel substantially in the shape of a cylinder and having a rubbery and flexible consistency, comprising about 10–80% water, about 20–85% humectant, about 10–30% acrylamide polymer crosslinked with about 0.04–0.2% crosslinker, and (b) a moisture permeable sheath encasing said gel.

10. Hair curler of claim 9 wherein said sheath is fabric.

11. Hair curler of claim 10 substantially covered by a moisture permeable fabric sleeve encasing said fabric sheath.

12. A hair curler of claim 10 including fastening means at each end of said hair curler.

13. Hair curler of claim 12 wherein said fastening means comprise extensions of said sleeve.

14. Hair curler of claim 10 wherein said fabric sheath is expansible.

15. A hair curler of claim 9 wherein said sheath is sufficiently permeable to permit moisture to pass outwardly when said curler is heated and to permit moisture to be absorbed from the air by said humectant when said curler is stored at ambient temperature.

16. Hair curler of claim 9 wherein said humectant comprises glycerine.

17. Hair curler of claim 9 wherein said crosslinker is methylene bisacrylamide.

18. Method of curling hair comprising heating a hair curler of claim 9, curling said hair around said hair curler, and retaining said hair around said hair curler for a time sufficient to impart a heightened curliness to said hair.

19. Method of claim 18 wherein said hair curler is heated in a microwave.

20. Method of claim 18 wherein said hair curler is encased in a moisture-permeable sleeve.

* * * * *